US007806704B2

(12) United States Patent
Miyoshi et al.

(10) Patent No.: US 7,806,704 B2
(45) Date of Patent: Oct. 5, 2010

(54) CONNECTOR

(75) Inventors: Toshiharu Miyoshi, Yao (JP); Hayato Kondo, Yao (JP)

(73) Assignee: Hosiden Corporation, Yao-shi (JP)

( * ) Notice: Subject to any disclaimer, the term of this patent is extended or adjusted under 35 U.S.C. 154(b) by 0 days.

(21) Appl. No.: 12/482,627

(22) Filed: Jun. 11, 2009

(65) Prior Publication Data

US 2010/0022138 A1 Jan. 28, 2010

(30) Foreign Application Priority Data

Jul. 22, 2008 (JP) ..... 2008-188838

(51) Int. Cl.
*H01R 13/648* (2006.01)

(52) U.S. Cl. ..... 439/108

(58) Field of Classification Search ..... 439/108
See application file for complete search history.

(56) References Cited

U.S. PATENT DOCUMENTS 6,164,995 A * 12/2000 Peloza ..... 439/188
6,280,209 B1 * 8/2001 Bassler et al. ..... 439/101
6,368,155 B1 * 4/2002 Bassler et al. ..... 439/620.21
6,379,184 B1 * 4/2002 Bassler et al. ..... 439/607.27
6,454,605 B1 * 9/2002 Bassler et al. ..... 439/607.23
6,457,983 B1 * 10/2002 Bassler et al. ..... 439/101
6,540,559 B1 * 4/2003 Kemmick et al. ..... 439/607.05
6,575,789 B2 * 6/2003 Bassler et al. ..... 439/607.23
6,863,549 B2 * 3/2005 Brunker et al. ..... 439/108
6,945,796 B2 * 9/2005 Bassler et al. ..... 439/101
6,969,268 B2 * 11/2005 Brunker et al. ..... 439/108
7,156,672 B2 * 1/2007 Fromm et al. ..... 439/101
7,165,981 B2 * 1/2007 Bassler et al. ..... 439/101
7,331,800 B2 * 2/2008 Winings et al. ..... 439/79
7,670,199 B2 * 3/2010 Nagata et al. ..... 439/101
2002/0022407 A1 * 2/2002 Niitsu et al. ..... 439/676
2003/0032316 A1 * 2/2003 Bassler et al. ..... 439/108
2003/0162446 A1 * 8/2003 Ho et al. ..... 439/660
2004/0058572 A1 * 3/2004 Fromm et al. ..... 439/101
2007/0218762 A1 * 9/2007 Liao et al. ..... 439/607
2008/0287007 A1 * 11/2008 Tu et al. ..... 439/607
2009/0017646 A1 * 1/2009 Nagata et al. ..... 439/65

(Continued)

FOREIGN PATENT DOCUMENTS

JP 2003-505826 A1 2/2003

(Continued)

*Primary Examiner*—Ross N Gushi
(74) *Attorney, Agent, or Firm*—Kratz, Quintos & Hanson, LLP

(57) ABSTRACT

The present invention provides a connector including an insulative body; a first differential signaling contact, disposed inside the body; a second differential signaling contact, disposed inside the body in spaced relation to and at an equal height level to the first differential contact; and a third contact, disposed inside the body, at a different height level from the differential signaling contacts, and positioned between the differential signaling contacts and offset toward one of the differential signaling contacts. The third contact includes a first overlapping portion that overlaps in plane position with the first differential signaling contact; and a second overlapping portion that overlaps in plane position with the second differential signaling contact. Overlap areas of the first and second overlapping portions relative to the first and second differential signaling contacts, respectively, are adjusted in accordance with an impedance difference between the first and second differential signaling contacts.

7 Claims, 8 Drawing Sheets

U.S. PATENT DOCUMENTS

| | | | | |
|---|---|---|---|---|
| 2010/0015831 | A1* | 1/2010 | Miyoshi | 439/218 |
| 2010/0022138 | A1* | 1/2010 | Miyoshi et al. | 439/660 |
| 2010/0068902 | A1* | 3/2010 | Fogg | 439/79 |
| 2010/0093189 | A1* | 4/2010 | Trout et al. | 439/63 |

FOREIGN PATENT DOCUMENTS

| | | |
|---|---|---|
| WO | WO 01/06602 A1 | 1/2001 |

* cited by examiner

CONNECTOR

The present application claims priority under 35 U.S.C. §119 of Japanese Patent Application No. 2008-188838 filed on Jul. 22, 2008, the disclosure of which is expressly incorporated by reference herein in its entity.

TECHNICAL FIELD

The present invention relates to connectors that are used mainly for high-speed digital signaling and are capable of providing good impedance matches.

BACKGROUND ART

There is a demand in recent years on connectors to be adapted for two kinds of standards, such as a new standard and a conventional standard. Meeting the demand, such a connector has contacts arranged inside its body at their respective positions predefined according to each of the standards. A contact conforming to the conventional standard may be disposed offset toward one of contacts of a differential pair conforming to the new standard.

The presence of such offset contact causes reduction in capacitance and increases in impedance of the one of the paired contacts. This further causes an impedance mismatch between the differential pair contacts, which leads to degradation of transmission characteristics of the connector.

A known means to match impedances of such differential pair contacts is that a ground contact is provided at a middle and lower position of the paired contacts, such that each widthwise end of the ground contact overlap in plane position with a widthwise end of each of the paired contacts (see Patent Literature 1).

Patent Literature 1 Japanese Published Patent Publication No. 2003-505826, based on the international application published as WO/01/006602

SUMMARY OF INVENTION

Technical Problem

The above known impedance matching means, however, requires ground contacts in addition to the differential pair contacts and the contacts of the conventional standard. The additional ground contacts will result in an increased number of components and a complicated general structure.

The present invention was conceived in view of the foregoing circumstances. An object of the invention is to provide a novel connector adapted for two kinds of standards and still is capable of providing a impedance match between contacts of differential pairs.

Solution to Problem

In order to overcome the above problem, a connector according to the present invention includes an insulative body; a first differential signaling contact, disposed inside the body; a second differential signaling contact, disposed inside the body in spaced relation to and at an equal height level to the first differential contact; and a third contact, disposed inside the body, at a different height level from the first and second differential signaling contacts, and positioned between the first and second differential signaling contacts and offset toward one of the first and second differential signaling contacts. The third contact includes a first overlapping portion that overlaps in plane position with the first differential signaling contact; and a second overlapping portion that overlaps in plane position with the second differential signaling contact. Overlap areas of the first and second overlapping portions relative to the first and second differential signaling contacts, respectively, are adjusted in accordance with an impedance difference between the first and second differential signaling contacts.

In such a connector, the overlap areas of the first and second overlapping portions relative to the first and second differential signaling contacts, respectively, are adjusted in accordance with the impedance difference between the first and second differential signaling contacts. As such, even in the case where the first and second differential signaling contacts are arranged according to a first standard while the third contact is positioned, according to a second standard, between the first and second differential signaling contacts and offset toward either one of the first and second differential signaling contacts, impedances can be matched between the first and second differential signaling contacts without providing a ground contact as in the conventional example. In other words, the third contact provided for a second standard can be utilized to match impedances between the first and second differential signaling contacts. Consequently, the connector of the invention is advantageously simple in structure, leading to reduced costs.

The overlap area of the first overlapping portions relative to the first differential signaling contact may be substantially as large as the overlap area of the second overlapping portion relative to the second differential signaling contact. In this aspect of the invention, the equalized overlap areas of the first and second overlapping portions means that the first and second differential signaling contacts have substantially the same capacitance, resulting in matched impedances between the first and second differential signaling contacts.

In the case where the first and second overlapping portions are provided at widthwise end portions of the third contact, at least one of the first and second overlapping portions may be extended in a width direction thereof. In this case, the widthwise extension of at least one of the first and second overlapping portions allows the overlap areas of the first and second overlapping portions to be equalized substantially relative to the first and second differential signaling contacts. In other words, impedances can be easily matched between the first and second differential signaling contacts merely by changing the width dimension of the third contact.

In the case where the third contact is elastically deformable toward the first and second differential signaling contacts when touched by a contact of a mating connector, the third contact may be provided with a resilience suppressor for suppressing increase in resilience of the third contact due to the widthwise extension of the at least one of the first and second overlapping portions. In this aspect of the invention, the resilience suppressor suppresses increase in resilience of the third contact due to the widthwise extension of the at least one of the first and second overlapping portions. Consequently, this aspect of the invention can advantageously suppress rise in contact pressure in the third contact that would be caused by the increased resilience of the third contact.

The resilience suppressor may be an opening provided in a middle portion between the first and second overlapping portions of the third contact. Such opening can suppress increase in resilience of the third contact due to the widthwise extension of the at least one of the first and second overlapping portions, limiting rise in contact pressure of the third contact. Accordingly, the third contact can be contacted at a desirable contact pressure with a mating contact. Moreover, the overlap areas of the first and second overlapping portions relative to the first and second differential signaling contacts can be adjusted by changing the shape and/or size of the opening. It is thus easy to tune impedance between the first and second differential signaling contacts. Further, the opening provided in the middle portion of the third contact provides decreased areas of overlap of the first and second overlapping portions of the third contact relative to the first and second differential signaling contacts, resulting in reduced impedances of the first and second differential signaling contacts.

The third contact may further include a coupling portion for coupling the first overlapping portion on a distal side with the second overlapping portion on a proximal side, and the coupling portion may be shaped to extend orthogonally or obliquely relative to the first and second overlapping portions. In this case, if the first and second overlapping portions are on the distal and proximal sides of the contact and has substantially equal overlap areas relative to the first and second differential signaling contacts, the two signaling contacts can be matched in impedance simply by providing the coupling portion that couples the first and second overlapping portions.

The third contact may further include, at a leading end thereof, a movable contact portion that is movable toward the first and second differential signaling contacts.

BRIEF DESCRIPTION OF DRAWINGS

FIGS. 11A to 11C are schematic plan views of modifications of a signaling contact of the connector, wherein FIG. 11A shows a shape without an opening, FIG. 11B shows a shape that a middle portion of an elastic deformation portion is bent, and FIG. 11C shows a state that semicircular overlapping portions are provided at edges of an elastic deformation portion.

DESCRIPTION OF EMBODIMENTS

A connector according to an embodiment of the present invention is described below with reference to FIGS. 1 to 10.

The connector exemplified herein is a receptacle connector that is connectable with a USB 3.0 compliant plug connector and a USB 2.0 compliant plug connector (not shown; in the following description, the former is referred to as a USB 3.0 plug, and the latter, a USB 2.0 plug).

Figure 1:
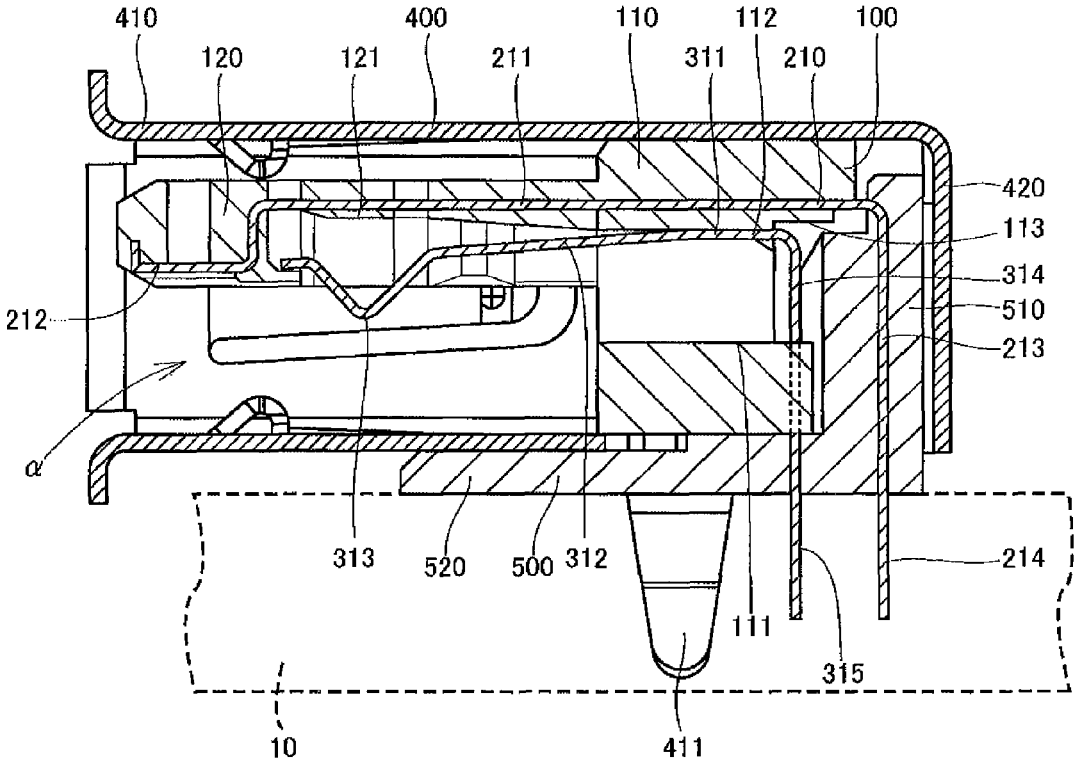
FIG. 1 is a general cross-sectional view of a connector according to an embodiment of the present invention.
Figure 2:
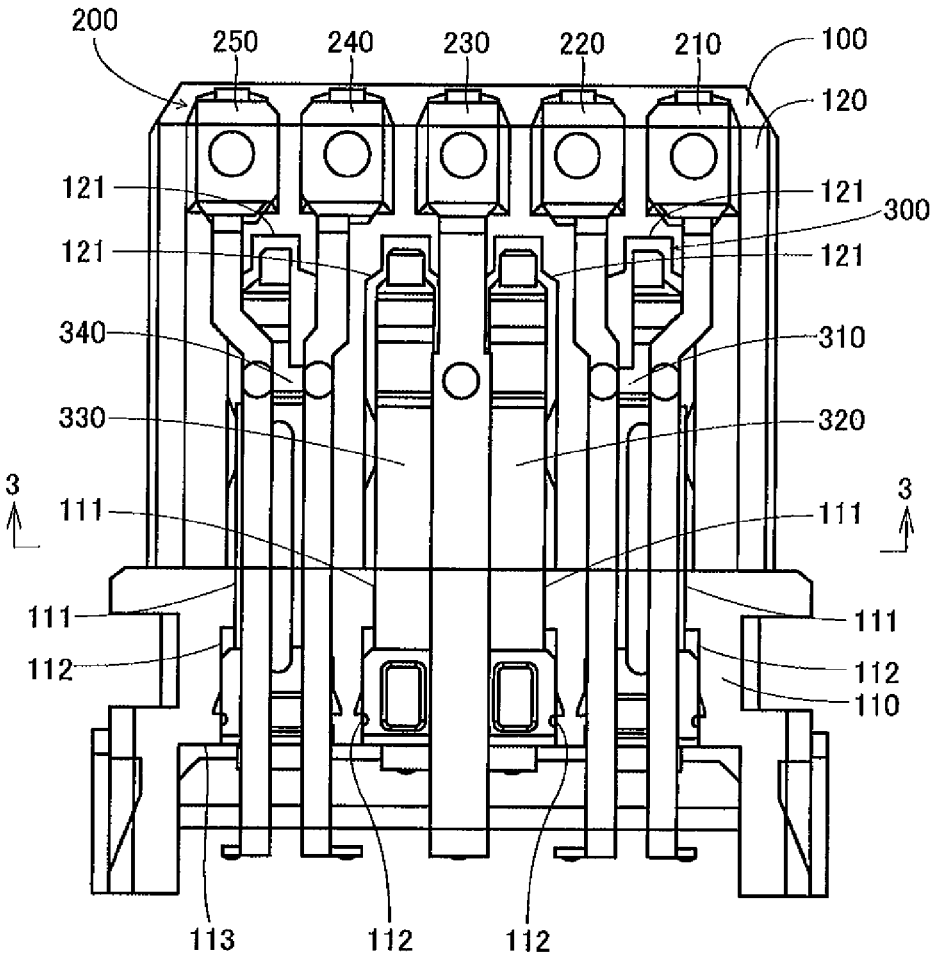
FIG. 2 is a transparently illustrated plan view of the connector with its shell removed.
Figure 3:
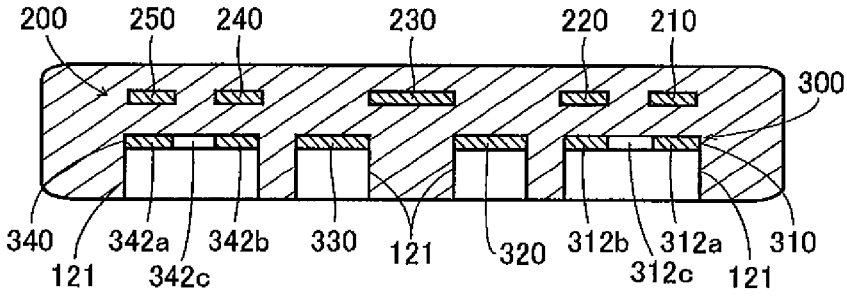
FIG. 3 is a schematic cross-sectional view taken along line 3-3 of FIG. 2.
Figure 4:
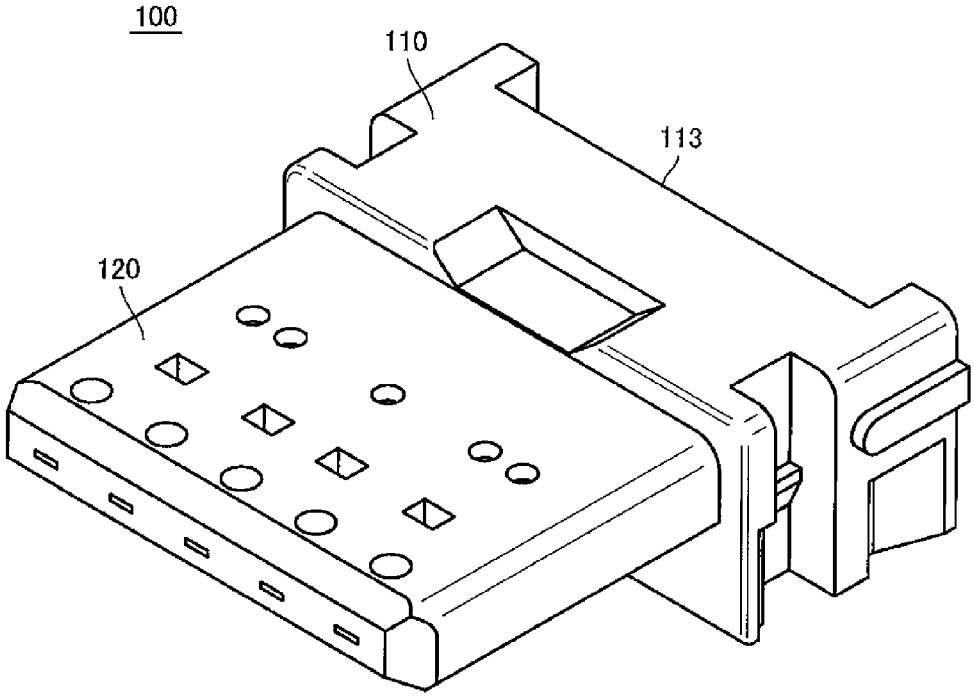
FIG. 4 is a general perspective view of a body of the connector.

As shown in FIGS. 1 to 3, the receptacle connector includes a body 100, a USB 3.0 contact group 200, a USB 2.0 contact group 300, and a shell 400 covering the body 100. Each of these parts will be described in detail below.

The body 100 is an injection molded article of general-purpose insulative synthetic resin, such as PBT (polybutylene terephthalate) or PPS (polyphenylene sulfide). As shown in FIGS. 1 to 5, the body 100 has a body main portion 110 of substantially rectangular parallelepiped shape and a plate-like protrusion 120 provided on the front side of the body main portion 110.

Figure 5:
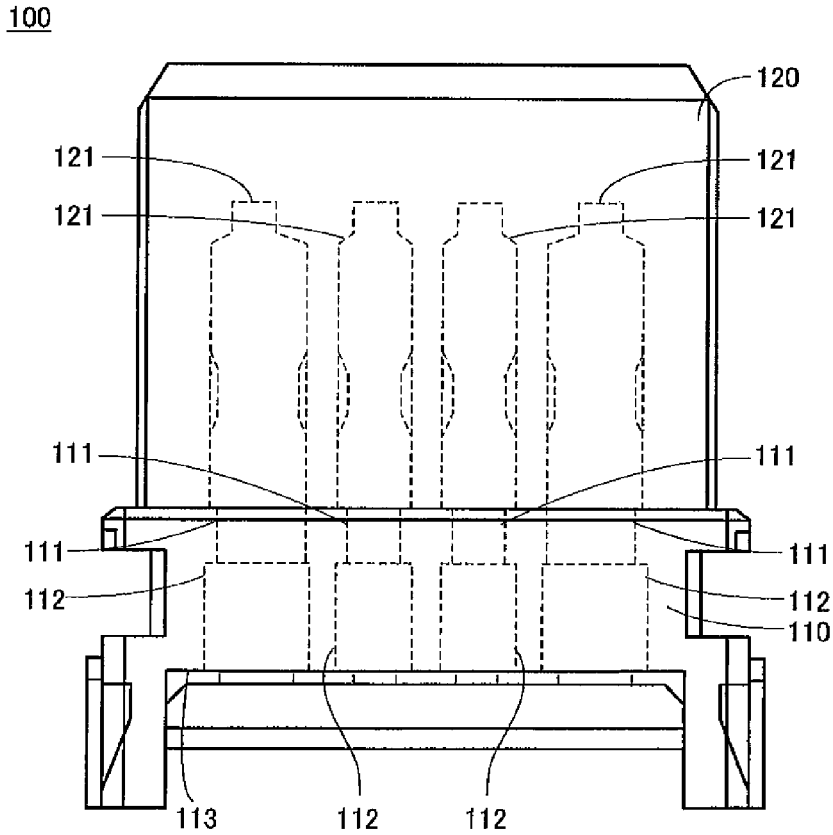
FIG. 5 is a transparently illustrated schematic bottom view of the body of the connector.

As shown in FIGS. 1, 2, and 5, the front side of the body main portion 110 has substantially rectangular front recesses 111 in its center. The front recesses 111 are four in number and placed in such a manner as to correspond to the arrangement of USB 2.0 plug contacts of the USB 2.0 plug. Four press-fit holes 112 are provided on top of the front recesses 111 and each communicate with the respective front recesses 111.

The press-fit holes 112 are formed to press-fittingly receive press fitting portions of contacts of the USB 2.0 contact group 300, namely, a Vbus contact 310, a Data− contact 320, a Data+ contact 330, and a GND contact 340, each of which contacts are described later. The contacts 310, 320, 330, and 340 received in the press-fit holes 112 are lead out at their elastic deformation portions (to be described) from the front recesses 111.

The rear side of the body main portion 110 has a rear recess 113 in its center, communicating with the four press-fit holes 112. The rear recess 113 is used to lead out lead-out portions (details to be described) of the contacts 310, 320, 330, and 340 of the USB 2.0 contact group 300 that are press fitted into the respective press-fit holes 112.

Figure 6:
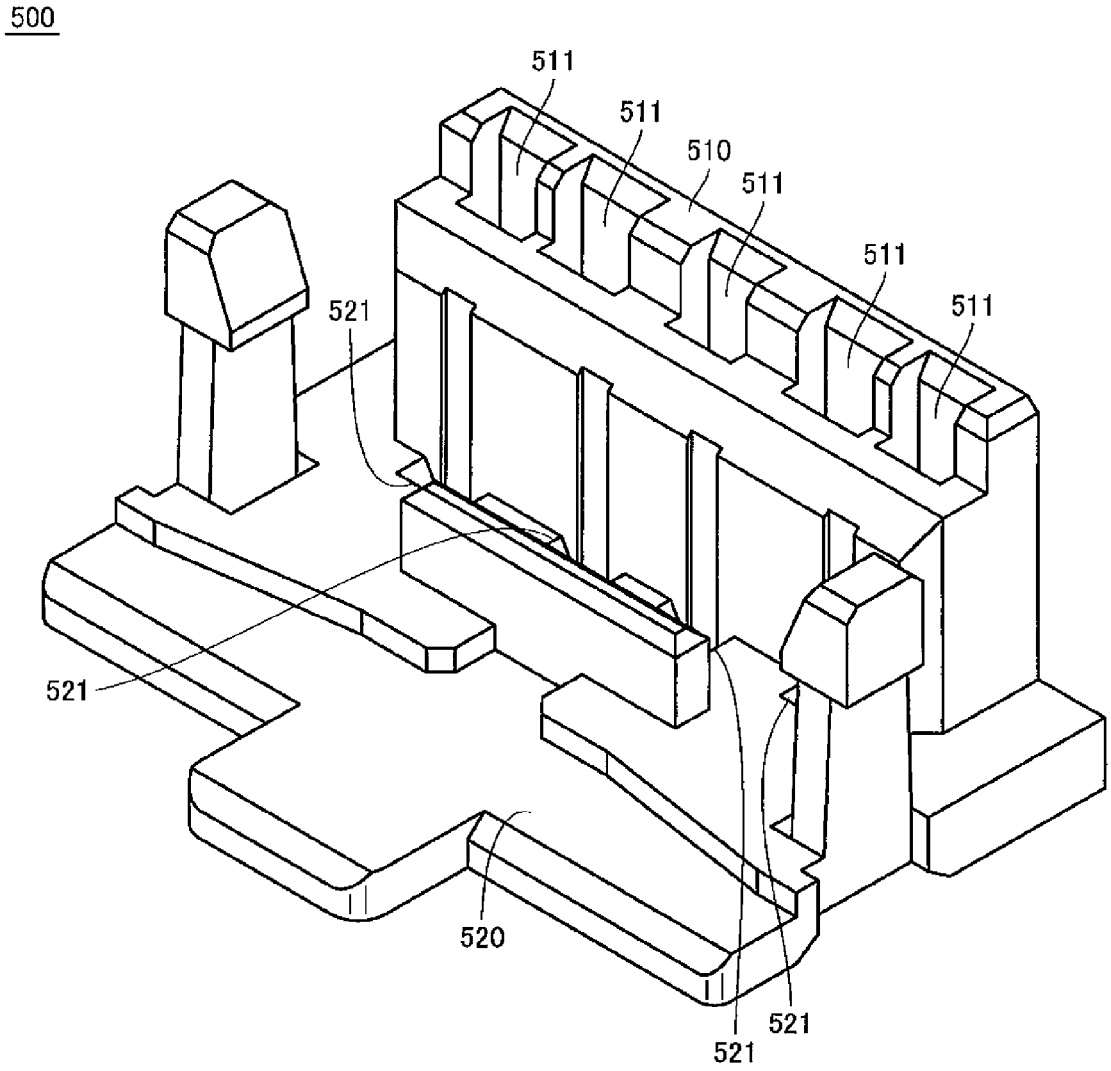
FIG. 6 is a general perspective view of a spacer of the connector.

The rear recess 113 of the body main portion 110 fittingly receives a perpendicular portion 510 of a plate-like spacer 500 of a substantially L shape in side view, as shown in FIG. 1. The spacer 500 is of a substantially L shape in cross section, injection molded from a general-purpose insulative synthetic resin, like the body 100. As shown in FIG. 6, the spacer 500 has the perpendicular portion 510 and a base portion 520 provided at a right angle to the perpendicular portion 510.

The perpendicular portion 510 is provided with a plurality of through holes 511 that allow lead-out portions (to be described) of contacts of the USB 3.0 contact group 200 to pass therethrough. The base portion 520 is a plate-like member that is placed on a circuit board 10 for mounting the present receptacle connector. The base portion 520 has a plurality of through holes 521 that allow the later-described lead-out portions of the contacts of the USB 2.0 contact group 300 to pass therethrough.

As shown in FIG. 1, the protrusion 120 and the lower end of the shell 400 define a plug insertion space $\alpha$ to receive a USB 3.0 plug or a USB 2.0 plug.

The protrusion 120 has substantially rectangular parallelepiped recesses 121 toward its bottom. There are four such recesses 121 communicating with the respective front recesses 111. The recesses 121 receive elastic deformation portions and movable contact portions, which are described later, of the Vbus contact 310, Data− contact 320, Data+ contact 330, and GND contact 340 of the USB 2.0 contact group 300.

The shell 400 is a rectangular tube member made of metal. As shown in FIG. 1, the shell 400 has a shell main portion 410 and a cover 420 that is continuous from an upper portion on the rear end of the shell main portion 410.

The shell main portion 410 covers the outer periphery of the body 100, such that the plug insertion space $\alpha$ is formed between the protrusion 120 of the body 100 and the lower end of the shell main portion 410. The shell main portion 410 is provided at opposite ends with a connecting pieces 411 (one of which is shown) to be connected to ground lines on the circuit board 10.

The cover 420 is bend at a substantially right angle relative to the shell main portion 410 to cover the rear end face of the spacer 500.

Figure 7:
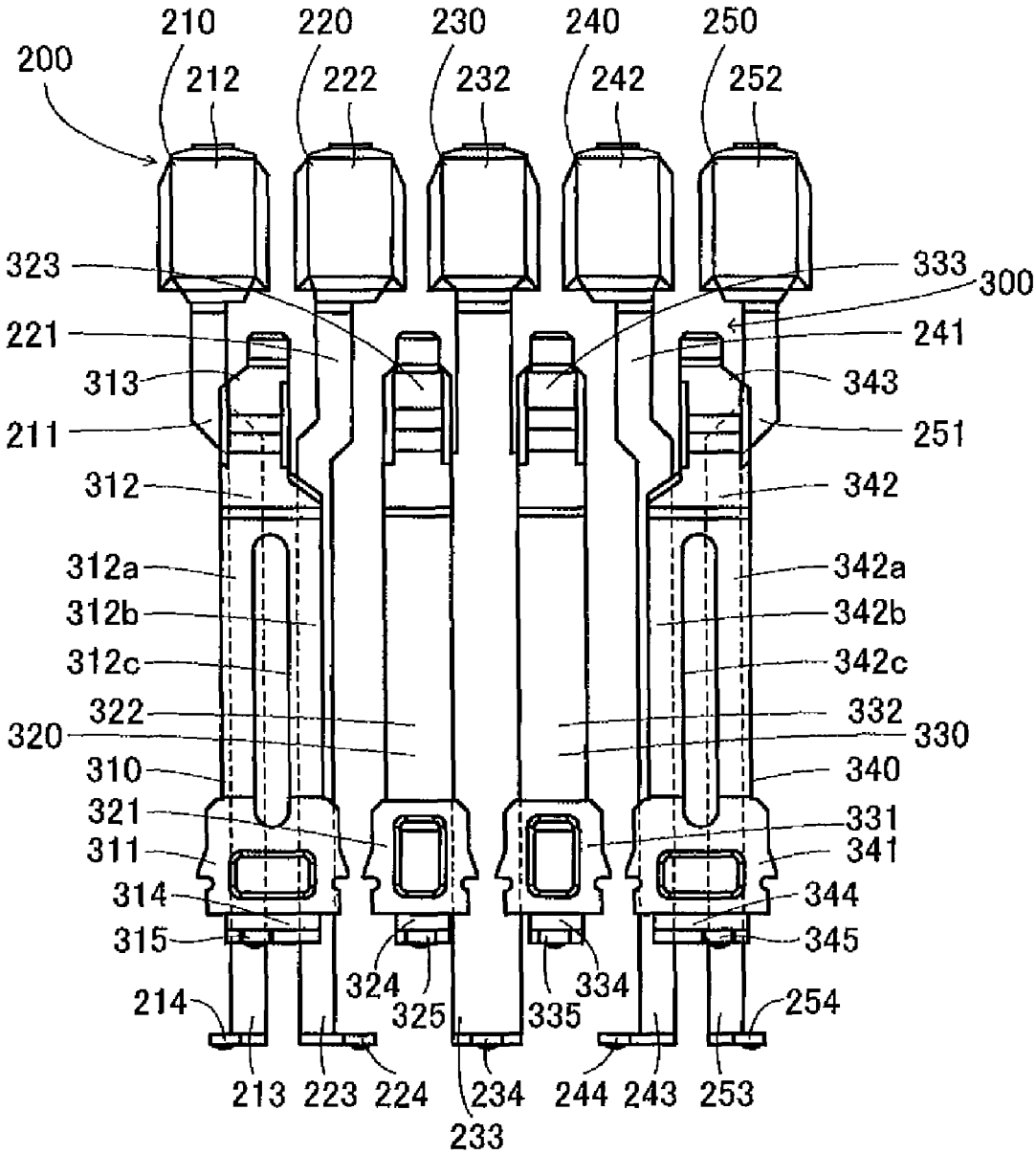
FIG. 7 is a general bottom view of contacts of the connector, illustrating the arrangement of the contacts.

The contacts of the USB 3.0 contact group 200 are arranged inside the body 100 at spaced intervals in the lateral direction of the body 100, in such a manner as to correspond to the array of the USB 3.0 plug contacts of the USB 3.0 plug. As shown in FIGS. 2, 3, and 7, the USB 3.0 contact group 200 includes a TX+ signaling contact 210 (a first differential signaling contact), a TX− signaling contact 220 (a second differential signaling contact), a ground contact 230, an RX+ signaling contact 240 (another first differential signaling contact), and an RX− signaling contact 250 (another second differential signaling contact).

Figure 8:
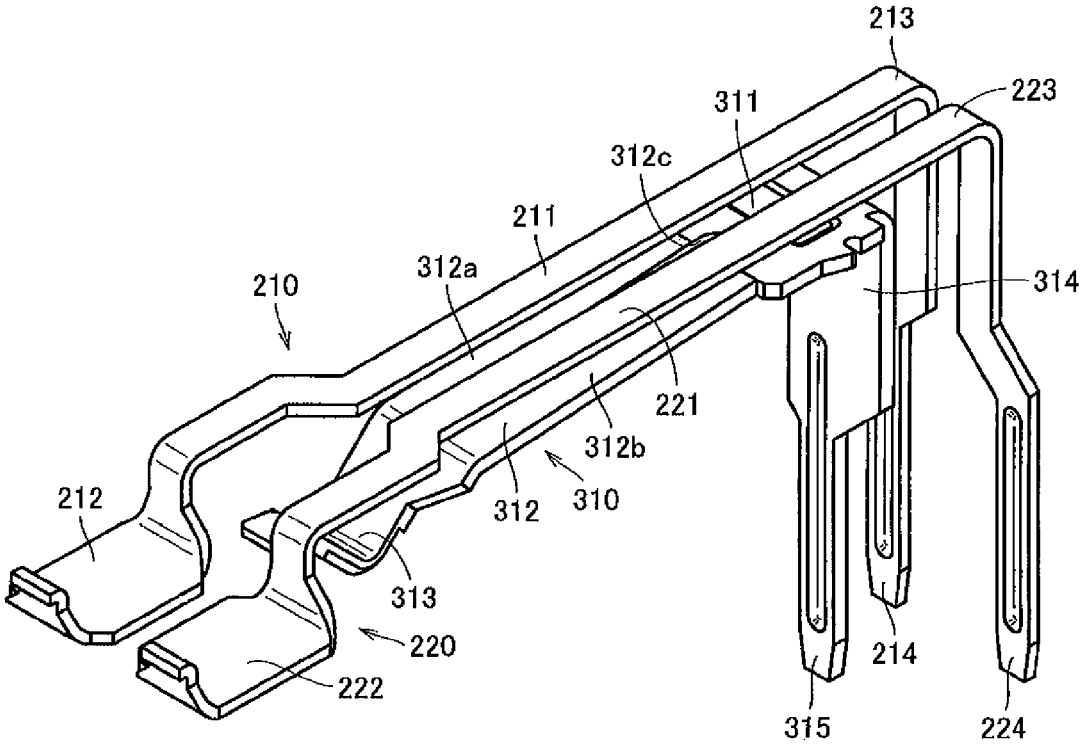
FIG. 8 is a general perspective view of a TX+ signaling contact, a TX− signaling contact, and a Vbus contact of the connector.
Figure 9A:
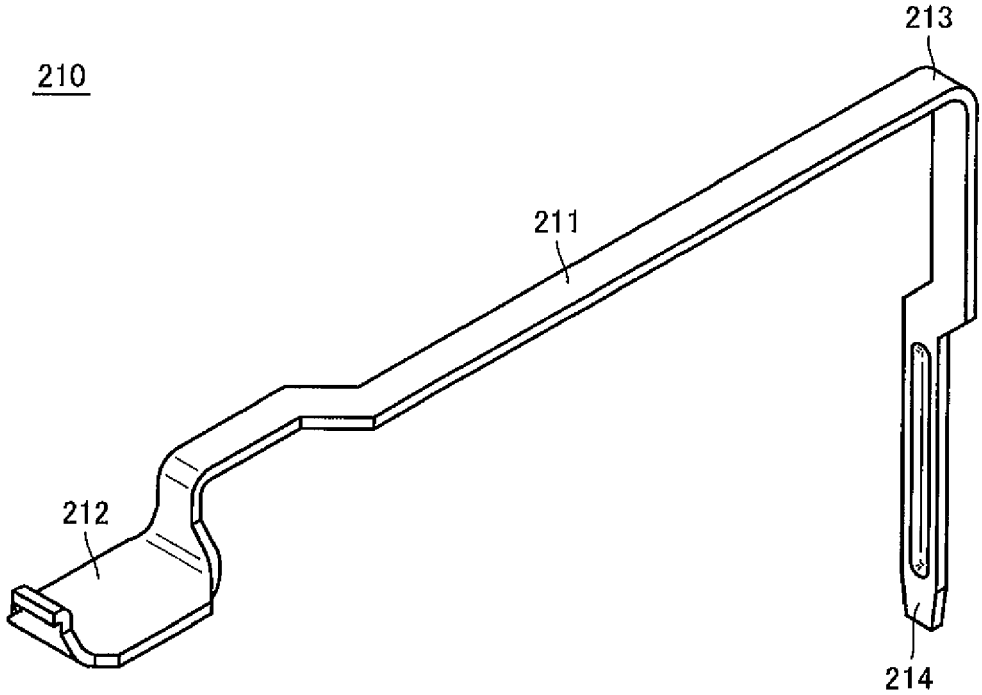
FIG. 9A is a general perspective view of the TX+ signaling contact of the connector.

As shown in FIGS. 8 and 9A, the TX+ signaling contact 210 is a conductive terminal of substantially L shape in cross-sectional view. The contact 210 has a main portion 211, a contact portion 212 continuous from the leading end of the main portion 211, a substantially L-shaped lead-out portion 213 continuous from the rear end of the main portion 211, and a plate-like connecting portion 214 continuous from the rear end of the lead-out portion 213.

The main portion 211 is of a plate-like shape with its leading end bent sideways. As shown in FIG. 1, the main portion 211 is embedded by means of insert molding above the front recess 111 and the recess 121 in the body main portion 110 and the protrusion 120 of the body 100.

The contact portion 212 is a plate-like member bent into a substantially U-shape in cross section, with a wider width than the main portion 211. The lower end of the contact portion 212 is exposed from the bottom of the protrusion 120, particularly at the leading side of the recess 121, so as to be contactable with a USB 3.0 plug contact.

The lead-out portion 213 of a substantially L shape in cross section is lead out from the rear recess 113. The lead-out portion 213 has a perpendicular portion to be passed through an associated one of the through holes 511 in the perpendicular portion 510 of the spacer 500.

The connecting portion 214 projects downward from the spacer 500 to be electrically connected to a predetermined signal line on the circuit board 10 by soldering or other means.

Figure 9B:
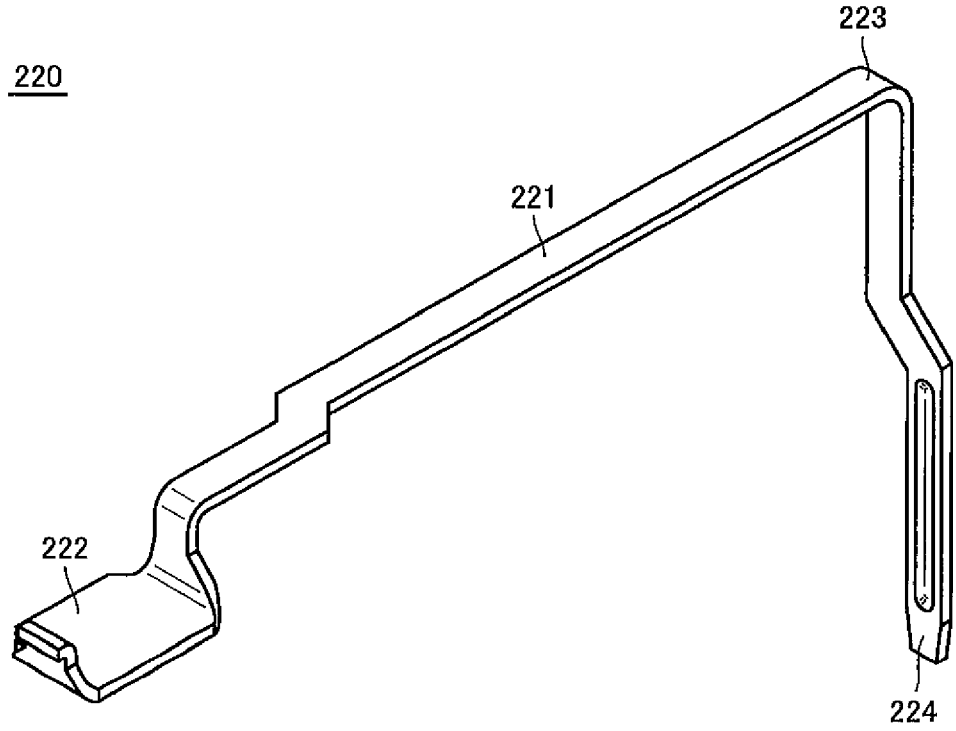
FIG. 9B is a general perspective view of the TX− signaling contact.

As shown in FIGS. 8 and 9B, the TX− signaling contact 220 is configured substantially the same as the TX+ signaling contact 210, except that the leading end of its main portion 221 is bent in an opposite direction to the leading end of the main portion 211. As shown in FIG. 7, the GND contact 230 is configured substantially the same as the TX+ signaling contact 210, except that the GND contact 230 has a main portion 231 in a straight line. Further, the RX+ signaling contact 240 is of the same shape and configuration as the TX− signaling contact 220 but is disposed symmetrically to the TX− signaling contact 220. The RX− signaling contact 250 is of the same shape and configuration as the TX+ signaling contact 210 but disposed symmetrically to the TX+ signaling contact 210. To avoid redundancy, detailed descriptions of these contacts will not be given.

The contacts of the USB 2.0 contact group 300 are arranged inside the body 100 at spaced intervals in the lateral direction of the body 100, in such a manner as to correspond to the array of the USB 2.0 plug contacts of the USB 2.0 plug. The USB 2.0 contact group 300 is disposed at a different height level in the body 100 from that of the USB 3.0 contact group 200. As shown in FIGS. 2, 3, and 7, the USB 2.0 contact group 300 includes the Vbus contact 310 (third contact), Data− contact 320, Data+ contact 330, and GND contact 340 (third contact).

Figure 10:
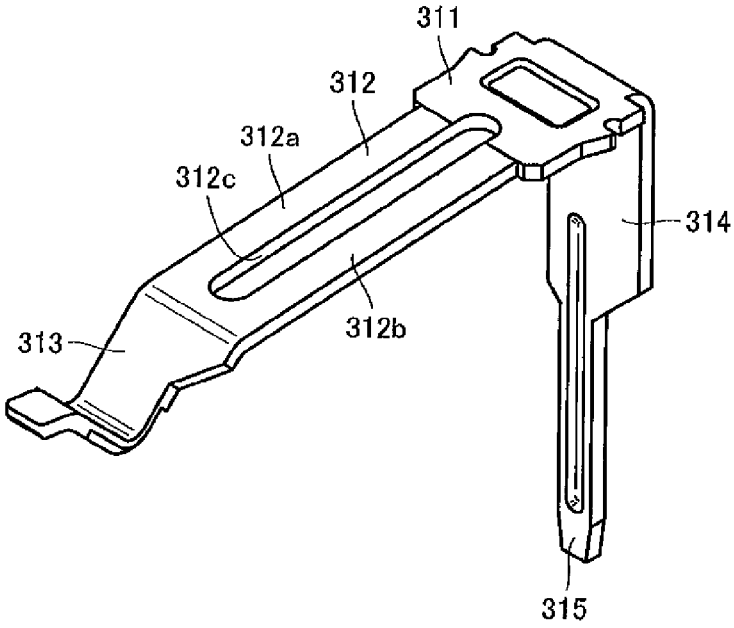
FIG. 10 is a general perspective view of the Vbus contact of the connector.

As shown in FIG. 8, the Vbus contact 310 is a conductive terminal of substantially L shape in cross-sectional view. It is smaller than the TX+ signaling contact 210 and other signaling contacts. As shown in FIGS. 1 and 10, the Vbus contact 310 has a press fitting portion 311, an elastic deformation portion 312 continuous from the leading end of the press fitting portion 311, a movable contact portion 313 continuous from the leading end of the elastic deformation portion 312, a lead-out portion 314 continuous from the rear end of the press fitting portion 311, and a connecting portion 315 continuous from the rear end of the lead-out portion 314.

As shown in FIGS. 2 and 8, a pair of projections is provided on respective lateral edges of the press fitting portion 311. The press fitting portion 311 including the projections is slightly larger in width dimension than the associated press-fit hole 112 in the body 100. Accordingly, the press fitting portion 311 when inserted into the press-fit hole 112 in the body 100 is held within the body 100. As shown in FIGS. 2 and 7, when the press fitting portion 311 is held in the body 100, the movable contact portion 313 is disposed below and between the TX+ signaling contact 210 and the TX− signaling contact 220, at a position offset toward the TX+ signaling contact 210, so as to conform to the USB 2.0 standard. The Vbus contact 310 is thus generally disposed offset toward the TX+ signaling contact 210.

As shown in FIGS. 1 and 7, the movable contact portion 313 is a plate-like member of substantially V shape in cross section with a smaller width than the elastic deformation portion 312. The movable contact portion 313, together with the elastic deformation portion 312, is inserted into the associated recess 121 in the body 100 with the press fitting portion 311 held within the body 100. In the inserted state, a nose tip of the movable contact portion 313 sticks out downward from the recess 121, so that the nose tip is sinkable in the recess 121. The leading end of the movable contact portion 313 abuts on a projection provided on the leading edge of the recess 121 to prevent the movable contact portion 313 from slipping down.

As shown in FIG. 1, the elastic deformation portion 312 is a rectangular plate-like member. It is bent and slanted downward so that it is elastically deformable upward. The elastic deformation portion 312 is inserted into the associated front recess 111 and the recess 121 in the body 100 with the press fitting portion 311 held within the body 100. In this inserted state, as shown in FIGS. 7 and 8, the elastic deformation portion 312 is disposed such that widthwise end portions 312*a* and 312*b* (first and second overlapping portions) overlap in plane position with the main portion 211 of the TX+ signaling contact 210 and the main portion 221 of the TX− signaling contact 220, respectively.

The overlap areas of the end portion 312*a* relative to the main portion 211 of the TX+ signaling contact 210 and of the end portion 312*b* relative to the main portion 221 of the TX− signaling contact 220 are adjusted in accordance with the impedance difference between the TX+ signaling contact 210 and the TX− signaling contact 220. In the present embodiment, of the widthwise end portions 312*a* and 312*b*, the widthwise end portion 312*b* on the side of the TX− signaling contact 220 is extended widthwise, such that the overlap area of the end portion 312*a* relative to the main portion 211 of the TX+ signaling contact 210 is substantially as large as the overlap area of the end portion 312*b* relative to the main portion 221 of the TX− signaling contact 220. In other words, the widthwise geometry of the elastic deformation portion 312 is defined such that a substantial impedance match is provided between the TX+ signaling contact 210 and the TX− signaling contact 220. The widths of the press fitting portion 311 and of the lead-out portion 314 are also set in accordance with the width of the elastic deformation portion 312.

The above structure advantageously provides correction of impedance mismatch between the TX+ signaling contact 210 and the TX− signaling contact 220 caused by the offset location of the Vbus contact 310 toward the TX+ signaling contact 210.

An elongated opening 312*c* (a resilience suppressor) is provided between the widthwise end portions 312*a* and 312*b* of the elastic deformation portion 312. The opening 312*c* thus reduces rise in resilience of the Vbus contact 310 due to the extension of the end portion 312*b* of the Vbus contact 310. Consequently, it is possible to suppress rise in contact pressure of the Vbus contact 310 against a USB 2.0 plug contact, which pressure rise would result from the rise in resilience of the Vbus contact 310. The contact pressure can be thus set to a predetermined value sufficient to allow suitable electrical connection with the USB 2.0 plug contact.

As shown in FIG. 1, the lead-out portion 314 is a plate-like member of substantially L shape in cross section. The lead-out portion 314 extends rearward out of the body 100. The lower end of the lead-out portion 314 passes through the associated through hole 521 in the base portion 520 of the spacer 500.

The connecting portion 315 is a linear plate-like member as shown in FIG. 1. It extends downward from the spacer 500 to be electrically connected to a predetermined signal line on the circuit board 10 by soldering or other means.

As shown in FIG. 7, the GND contact 340 is of symmetrical configuration to the Vbus contact 310. It only defers from the Vbus contact 310 in that its widthwise end portions 342*a* and 342*b* overlap in plane position with the RX− signaling contact 250 and the RX+ signaling contact 240, respectively. Thus, the GND contact 340 will not be described in detail.

As shown in FIG. 7, the Data− contact 320 is a plate-like member of substantially L shape in cross section, with substantially the same configuration as the Vbus contact 310. The Data− contact 320 has a press fitting portion 321, an elastic deformation portion 322 continuous from the leading end of the press fitting portion 321, a movable contact portion 323 continuous from the leading end of the elastic deformation portion 322, a lead-out portion 324 continuous from the rear end of the press fitting portion 321, and a connecting portion 325 continuous from the rear end of the lead-out portion 324.

The press fitting portion 321 is configured substantially the same as the press fitting portion 311, except that the press fitting portion 321 is smaller in width than the press fitting potion 311. When the press fitting portion 321 is press fitted into the associated press-fit hole 112 in the body 100, the Data− contact 320 is located at a lower and rightward position of the GND contact 230 as illustrated in FIG. 3.

The movable contact portion 323 is a plate-like member of substantially V shape in cross section, similar to the movable contact portion 313. The elastic deformation portion 322 is configured the same as the elastic deformation portion 312, except that the elastic deformation portion 322 is equal in width dimension to the movable contact portion 323 and has no opening corresponding to the opening 312*c*. The lead-out portion 324 and the connecting portion 325 are also configured substantially the same as the lead-out portion 314 and the connecting portion 315, respectively, except for their width dimensions being different from those of the lead-out portion 314 and the connecting portion 315.

The Data+ contact 330 is of the same type as the Data− contact 320. When the press fitting portion 331 is press fitted into the associated press-fit hole 112 in the body 100, the Data+ contact 330 is located at a lower and leftward position of the GND contact 230 as illustrated in FIG. 3. No further descriptions will be given here, referring to the descriptions of the Data− contact 320.

When the receptacle connector configured as above receives a USB 3.0 plug in its plug insertion space α, the USB 3.0 plug contacts are brought into contact with the respective contact portions 212, 222, 232, 242, and 252 of the USB 3.0 contact group 200.

At this time, the movable contact portions 313, 323, 333, and 343 of the USB 2.0 contact group 300 are applied with pressure from the USB 3.0 plug, and the movable contact portions 313, 323, 333, and 343 and the elastic deformation portions 312, 322, 332, and 342 are elastically deformed upward inside the front recesses 111 and the recesses 121 in the body 100. As a result, the movable contact portions 313, 323, 333, and 343 and the elastic deformation portions 312, 322, 332, and 342 become substantially parallel to the main portions 211, 221, 231, and 241 of the USB 3.0 contact group 200.

When a USB 2.0 plug is inserted into the plug insertion space α, the movable contact portions 313, 323, 333, and 343 of the USB 2.0 contact group 300 are pressed against the USB 2.0 plug contacts. This causes the movable contact portions 313, 323, 333, and 343 and the elastic deformation portions 312, 322, 332, and 342 to elastically deform upward inside the front recesses 111 and the recesses 121 in the body 100, and the movable contact portions 313, 323, 333, and 343 and the elastic deformation portions 312, 322, 332, and 342 become parallel to the main portions 211, 221, 231, and 241 of the USB 3.0 contact group 200.

In the receptacle connector according to the above embodiment, of the widthwise end portions 312*a* and 312*b* of the Vbus contact 310, one end 312*b* is extended widthwise, such that the overlap area of the end portion 312*a* relative to the main portion 211 of the TX+ signaling contact 210 is substantially as large as the overlap area of the end portion 312*b* relative to the main portion 221 of the TX− signaling contact 220. Similarly, of the widthwise end portions 342*a* and 342*b* of the GND contact 340, one end 342*b* is extended widthwise, such that the overlap area of the end portion 342*a* relative to the main portion 251 of the RX− signaling contact 250 is substantially as large as the overlap area of the end portion 342*b* relative to the main portion 241 of the RX+ signaling contact 240. For this reason, even in the case where the Vbus contact 310 is disposed offset toward the TX+ signaling contact 210 to conform to the USB 2.0 standard, impedance is matched between the TX+ signaling contact 210 and the TX− signaling contact 220 with no need of using a ground contact as in the conventional example. Further, in the case where the GND contact 340 is disposed offset toward the RX− signaling contact 250 to conform to the USB 2.0 standard, impedance is matched between the RX+ signaling contact 240 and the RX− signaling contact 250 with no need of using a ground contact as in the conventional example. In other words, the Vbus contact 310 and the GND contact 340 of the USB 2.0 standard may be utilized to effect impedance matching between the TX+ signaling contact 210 and the TX− signaling contact 220 and between the RX+ signaling contact 240 and the RX− signaling contact 250. Such connector can be manufactured with a simple structure and in reduced costs.

Moreover, since the Vbus contact 310 and the GND contact 340 are provided with the openings 312*c* and 342*c* in their middle portions, the openings can reduce the resilience of the Vbus contact 310 and GND contact 340 that would be increased by the extension of the end portions 312*b* and 342*b*. As a result, the contact pressures of the Vbus contact 310 and GND contact 340 against a USB 2.0 plug contact can be reduced to a desirable degree.

Further, the overlap areas of the end portions 312*a* and 312*b* relative to the TX+ signaling contact 210 and the TX− signaling contact 220 may be adjusted by changing the size and/or shape of the opening 312*c*. As such, impedance tuning is easily effected between the TX+ signaling contact 210 and the TX− signaling contact 220. Similarly, impedance tuning is easily effected between the RX+ signaling contact 240 and the RX− signaling contact 250 by changing the size and/or shape of the opening 342*c*.

Further, providing the openings 312*c* and 342*c* in the middle portions also result in decreased overlap areas of of the end portions 312*a* and 312*b* relative to the TX+ signaling contact 210 and the TX− signaling contact 220, as well as decreased overlap areas of the end portions 342*a* and 342*b* relative to the RX− signaling contact 250 and the RX+ signaling contact 240, respectively. Accordingly, decreased impedances are attained in the TX+ signaling contact 210, TX− signaling contact 220, RX+ signaling contact 240, and RX− signaling contact 250.

Figure 11A:
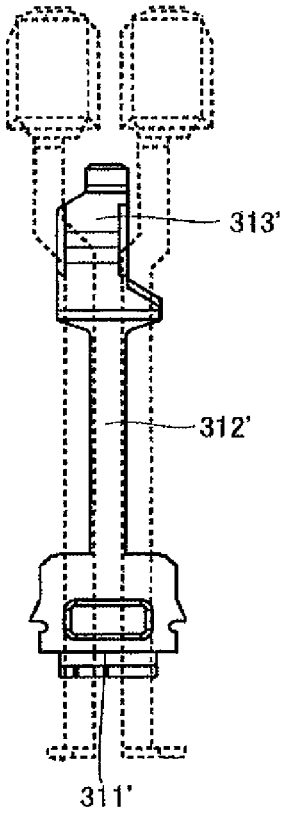
Figure 11B:
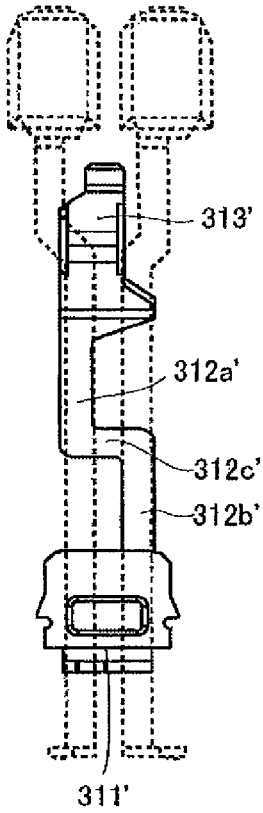
Figure 11C:
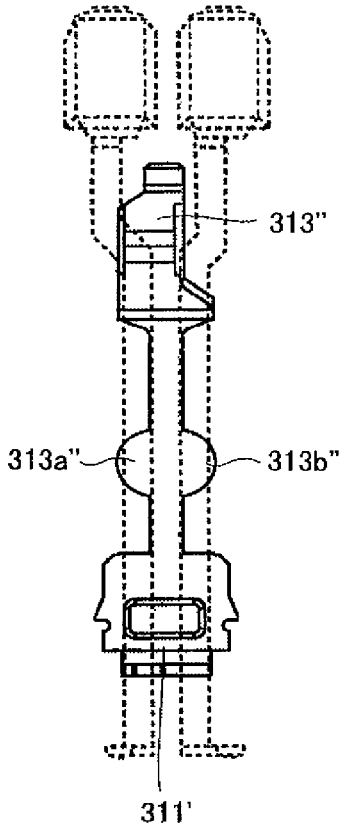

The connector described above may be appropriately modified inasmuch as the modification is within the scope of the claims. Exemplary modifications will be described in detail below. FIGS. 11A to 11C are schematic bottom views showing modified third contacts of the connector according to the embodiment of the present invention, wherein FIG. 11A illustrates a shape in which no opening is provided, FIG. 11B illustrates a shape in which the elastic deformation portion is bent at its middle portion, and FIG. 11C illustrates a state in which semicircular overlapping portions are provided on the widthwise ends of an elastic deformation portion.

The body 100 may be appropriately modified inasmuch as the body is capable of holding a first differential signaling contact disposed inside the body, a second differential signaling contact disposed inside the body in spaced relation to and at an equal height level to the first differential contact, and a third contact disposed inside the body at a different height level from the first and second differential signaling contacts and positioned between the first and second differential signaling contacts and offset toward one of the first and second differential signaling contacts.

The shapes and arrangement of the contacts of the USB 3.0 contact group 200 are not limited to those of the foregoing embodiments but may be modified appropriately. More specifically, the USB 3.0 contact group 200 of the present invention is not limited to one conforming to the USB 3.0 standard, but may be configured in accordance with any other appropriate standard.

In addition, although the contacts of the USB 3.0 contact group 200 are embedded within the body 100 in the above embodiment, the present invention is not limited thereto. For example, the body 100 may have additional press-fit holes, similar to ones for the Vbus contact 310 and the other USB 2.0 contacts, and these additional holes may press-fittingly receive the contacts of the USB 3.0 contact group 200.

In the foregoing embodiments, the first and second differential signaling contacts are the TX+ signaling contact 210, TX− signaling contact 220, RX+ signaling contact 240, and RX− signaling contact 250. However, the present invention is implementable as long as at least one pair of differential signaling contacts is provided.

The shapes and arrangement of the contacts of the USB 2.0 contact group 300 are not limited to those of the foregoing embodiments but may be modified appropriately. More specifically, the USB 2.0 contact group 300 of the present invention is not limited to one conforming to the USB 2.0 standard, but may be in accordance with any other appropriate standard.

While the contacts of the USB 2.0 contact group 300 are press fitted into the press-fit holes 112 in the body 100, the present invention is not limited thereto. For example, the contacts of the USB 2.0 contact group 300 may be embedded within the body 100 in the same manner as the USB 3.0 contact group 200.

In the foregoing embodiments, the third contacts are the Vbus contact 310 and the GND contact 340. However, the third contacts may be signaling contacts or any other kinds of contacts. The minimum number of the third contacts required is one.

The third contacts may be appropriately modified, if the following conditions are met. Firstly, the third contacts should be each disposed at a different height level from the first and second differential signaling contacts and positioned between the first and second differential signaling contacts and offset toward one of the first and second differential signaling contacts. Secondly, the third contacts should each have a first overlapping portion that overlap in plane position with the first differential signaling contact and a second overlapping portion that overlap in plane position with the second differential signaling contact, wherein the overlap areas of the first and second overlapping portions are adjusted in accordance with the impedance difference between the first and second differential signaling contacts. Accordingly, the overlap areas do not have to be substantially equal as in the foregoing embodiments.

In the above embodiments, the first and second overlapping portions are the widthwise end portions 312*a*, 312*b*, 342*a*, and 342*b* of the elastic deformation portions 312 and 342. However, the present invention is not limited thereto, but other portions of the elastic deformation portions may be overlapped in plane position with the differential signaling contacts.

FIG. 11A exemplifies a modified third contact (Vbus contact 310'), in which an elastic deformation portion 312' may be shaped such that, instead of extending either of its widthwise end portions, one end portion (first overlapping portion) relative to the first differential signaling contact has a substantially same overlap area with the other end portion (second overlapping portion) relative to the second differential signaling contact.

FIG. 11B illustrates another modification of the third contact. Particularly, the elastic deformation portion 312' has a distal end portion 312*a*' (first overlapping portion), a proximal end portion 312*b*' (second overlapping portion), and a coupling portion 312*c*' that couples the distal end portion 312*a*' with the proximal end portion 312*b*'. The coupling portion 312*c*' extends orthogonal to the distal end portion 312*a*' and to the proximal end portion 312*b*'. Such modified third contact may also provide matched impedances between the first and second differential signaling contacts if the distal end portion 312*a*' and the proximal end portion 312*b*' have overlap areas substantially equalized relative to the first and second differential signaling contacts, respectively. The coupling portion 312*c*' may be oblique relative to the distal end portion 312*a*' and to the proximal end portion 312*b*'.

FIG. 11C illustrates still another modification of the third contact. Particularly, an elastic deformation portion 312" has semicircular overlapping portions 312*a*" and 312" centrally. If the overlap areas of the overlapping portions 312*a*" and 312*b*" are set substantially equal relative to the first and second differential signaling contacts, impedance can be matched between the first and second differential signaling contacts.

The third contacts of the above embodiment have the elastic deformation portions 312 and 342, and the movable contact portions 313 and 343 are elastically deformable upward, but the present invention is not limited thereto. The third contacts may be so shaped as to be elastically undeformable.

Moreover, in the foregoing embodiment, the openings 312*c* and 342*c* are provided in the middle portions of the third contacts as resilience suppressors, but it is optional whether or not to provide the resilience suppressors. The resilience suppressors are not limited to openings and may be modified appropriately inasmuch as they can suppress resilience of the third contacts that would be increased by width extension of the contacts for impedance matching. For example, the resilience suppressors may be cutouts provided in ends of proximal end portions of the elastic deformation portions 312 and 342 or may be thin portions provided in the elastic deformation portions 312 and 342.

The connector according to the above embodiment is described as a connector conforming to the two kinds of standards, namely, the USB 2.0 and USB 3.0 standards. However, the present invention is not limited thereto but may conform to any other appropriate standard. The connector is described above as a receptacle, but the connector of the invention is applicable to a plug connector with contacts connected to a cable.

REFERENCE SIGNS LIST

100 Body
210 TX+ signaling contact (first differential signaling contact)
220 TX− signaling contact (second differential signaling contact)
240 RX+ signaling contact (first differential signaling contact)
250 RX− signaling contact (second differential signaling contact)
310 Vbus contact (third contact)
  312*a* End portion (second overlapping portion)
  312*b* End portion (first overlapping portion)
  312*c* Opening (resilience suppressor)
  313 Movable contact portion
340 GND contact (third contact)
  342*a* End portion (second overlapping portion)
  342*b* End portion (first overlapping portion)
  342*c* Opening (resilience suppressor)
  343 Movable contact portion
400 Shell

CITATION LIST

Patent Literature 1 Japanese Published Patent Publication No. 2003-505826, based on the international application published as WO/01/006602

The invention claimed is:

1. A connector comprising:

an insulative body;

a first differential signaling contact, disposed inside the body;

a second differential signaling contact, disposed inside the body, in spaced relation to and at an equal height level to the first differential contact; and a third contact, disposed inside the body, at a different height level from the first and second differential signaling contacts, and positioned between the first and second differential signaling contacts and offset toward one of the first and second differential signaling contacts, the third contact including:

a first overlapping portion that overlaps in plane position with the first differential signaling contact; and a second overlapping portion that overlaps in plane position with the second differential signaling contact, wherein overlap areas of the first and second overlapping portions relative to the first and second differential signaling contacts, respectively, are adjusted in accordance with an impedance difference between the first and second differential signaling contacts.

2. The connector according to claim 1, wherein the overlap area of the first overlapping portions relative to the first differential signaling contact is substantially as large as the overlap area of the second overlapping portion relative to the second differential signaling contact.

3. The connector according to claim 2, wherein the third contact further includes a coupling portion for coupling the first overlapping portion on a distal side with the second overlapping portion on a proximal side, and the coupling portion extends orthogonally or obliquely relative to the first and second overlapping portions.

4. The connector according to claim 2, wherein the first and second overlapping portions are provided at widthwise end portions of the third contact, and at least one of the first and second overlapping portions is extended in a width direction thereof.

5. The connector according to claim 4, wherein the third contact is elastically deformable toward the first and second differential signaling contacts when touched by a contact of a mating connector, and the third contact further includes a resilience suppressor for suppressing increase in resilience of the third contact due to the widthwise extension of the at least one of the first and second overlapping portions.

6. The connector according to claim 5, wherein the resilience suppressor comprises an opening provided in a middle portion between the first and second overlapping portions of the third contact.

7. The connector according to claim 5, wherein the third contact further includes a movable contact portion at a distal end thereof, the movable contact portion being movable toward the first and second differential signaling contacts.

* * * * *